US008267015B2

(12) United States Patent
Marx

(10) Patent No.: US 8,267,015 B2
(45) Date of Patent: Sep. 18, 2012

(54) MULTI-COMPONENT PROJECTILE ROTATIONAL INTERLOCK

(75) Inventor: PJ Marx, Sarasota, FL (US)

(73) Assignee: Liberty Ammunition, Inc., Clearwater, FL (US)

( * ) Notice: Subject to any disclaimer, the term of this patent is extended or adjusted under 35 U.S.C. 154(b) by 0 days.

(21) Appl. No.: 12/784,647

(22) Filed: May 21, 2010

(65) Prior Publication Data

US 2011/0155014 A1 Jun. 30, 2011

Related U.S. Application Data

(63) Continuation-in-part of application No. 11/255,261, filed on Oct. 21, 2005, now Pat. No. 7,748,325.

(60) Provisional application No. 61/326,833, filed on Apr. 22, 2010.

(51) Int. Cl.
*F42B 30/02* (2006.01)
*F42B 12/02* (2006.01)

(52) U.S. Cl. ..... 102/517; 102/506; 102/501

(58) Field of Classification Search ..... 102/501, 102/506, 517, 524
See application file for complete search history.

(56) References Cited

U.S. PATENT DOCUMENTS

| | | | | |
|---|---|---|---|---|
| RE1,247 | E | | 12/1861 | Hotchkiss |
| 34,493 | A | | 2/1862 | Havens |
| 998,712 | A | | 7/1911 | McNair |
| 1,169,704 | A | | 1/1916 | Wesner |
| 4,112,846 | A | | 9/1978 | Gilbert et al. |
| 4,242,960 | A | | 1/1981 | Boeder et al. |
| 4,301,733 | A | | 11/1981 | Arciniega Blanco |
| 4,708,063 | A | | 11/1987 | Ladriere |
| 4,825,518 | A | * | 5/1989 | Schiestl et al. ..... 86/51 |
| 4,900,038 | A | * | 2/1990 | Czetto et al. ..... 473/570 |
| 5,183,963 | A | | 2/1993 | Beaufils et al. |
| 5,388,524 | A | | 2/1995 | Strandli et al. |
| 6,085,662 | A | | 7/2000 | Nilsson |
| 6,305,293 | B1 | | 10/2001 | Fry et al. |
| 6,502,516 | B1 | | 1/2003 | Kinchin |
| 6,581,522 | B1 | | 6/2003 | Julien et al. |
| 6,684,792 | B2 | | 2/2004 | Denis |

FOREIGN PATENT DOCUMENTS

| | | |
|---|---|---|
| FR | 1166011 | 1/1957 |
| FR | 2662789 | 5/1990 |

* cited by examiner

*Primary Examiner* — James Bergin
(74) *Attorney, Agent, or Firm* — Ronald E. Smith; Anton J. Hopen; Smith & Hopen, P.A.

(57) ABSTRACT

A projectile has a leading part, a trailing part and a cylindrical interface that interconnects the leading and trailing parts. A non-round aperture having a predetermined longitudinal extent is formed in the trailing end of the leading part and a non-round peg having a predetermined longitudinal extent substantially equal to the predetermined longitudinal extent of the non-round aperture is formed in the leading end of the trailing part. The non-round peg is slideably inserted within the non-round aperture when the leading end of the cylindrical interface abuts the trailing end of the leading part and the trailing end of the cylindrical interface abuts the leading end of the trailing part so that the leading and trailing parts of the projectile rotate conjointly with one another when the projectile is rotating about its axis of rotation.

7 Claims, 2 Drawing Sheets

MULTI-COMPONENT PROJECTILE ROTATIONAL INTERLOCK

CROSS-REFERENCE TO RELATED APPLICATIONS

This application is a continuation-in-part of and claims priority to U.S. patent application Ser. No. 11/255,261, entitled: "Firearms Projectile," filed Oct. 21, 2005 by the same inventor, which application is hereby incorporated by reference into this application. This application also claims priority to U.S. Provisional Patent Application Ser. No. 61/326,833 filed Apr. 22, 2010, which application is hereby incorporated by reference into this application.

BACKGROUND OF THE INVENTION

1. Field of the Invention

This invention relates, generally, to the art of projectiles. More particularly, it relates to multi-component projectiles.

2. Description of the Prior Art

Conventional multi-component projectiles lose synchronized rotation in flight, i.e., at least one component will rotate at a rate different from the rotation rate of at least one other component. This loss of synchronized rotation diminishes the range, accuracy and kinetic energy of the projectile.

Thus there is a need for a multi-component projectile having a structure that enables all of the components to rotate at the same rate.

However, in view of the art considered as a whole at the time the present invention was made, it was not obvious to those of ordinary skill in the art how such a projectile could be provided.

SUMMARY OF THE INVENTION

The long-standing but heretofore unfulfilled need for a multi-component projectile having a synchronized rotation is now met by a new, useful, and non-obvious invention.

The inventive projectile has a leading part, a trailing part and a cylindrical interface that interconnects the leading and trailing parts. More particularly, a leading end of the cylindrical interface abuttingly engages a trailing end of the leading part and a trailing end of the cylindrical interface abuttingly engages a leading end of the trailing part.

A non-round aperture having a predetermined longitudinal extent is formed in the trailing end of the leading part and a non-round peg having a predetermined longitudinal extent substantially equal to the predetermined longitudinal extent of the non-round aperture is formed in the leading end of the trailing part.

The non-round aperture and the non-round peg are centered on a longitudinal axis of symmetry of the projectile which is also the axis of rotation of the projectile.

The non-round peg is slideably inserted within the non-round aperture when the leading end of the cylindrical interface abuts the trailing end of the leading part and the trailing end of the cylindrical interface abuts the leading end of the trailing part so that the leading and trailing parts of the projectile rotate conjointly with one another when the projectile is rotating about its axis of rotation.

The leading part is provided in the form of a tip or nose cone having an ogive configuration. The novel structure may also include a tip base of cylindrical construction having a reduced diameter relative to a trailing end of the tip so that a first annular shoulder is formed where the trailing end of the tip meets a leading end of the tip base.

The novel structure may further include a leading rod formed integrally with the tip base. The leading rod has a reduced diameter relative to the tip base so that a second annular shoulder is formed where a trailing end of the tip base meets a leading end of the leading rod.

The trailing part of the novel structure includes a main base and may also include a truncate base of cylindrical construction formed integrally with a leading end of the main base. The truncate base has a reduced diameter relative to the leading end of the main base so that a third annular shoulder is formed where the leading end of the main base meets a trailing end of the truncate base.

An embodiment that includes the truncate base further includes a trailing rod formed integrally with a leading end of the truncate base. The trailing rod has a reduced diameter relative to the truncate base so that a fourth annular shoulder is formed where the leading end of the truncate base meets the trailing end of the trailing rod.

In an embodiment including the leading rod and the trailing rod, a non-round aperture is formed in the trailing end of the leading rod and a non-round peg is formed in the leading end of the trailing rod. When the leading end of the cylindrical interface abuttingly engages the first annular shoulder and the trailing end of the cylindrical interface abuttingly engages the third annular shoulder, the non-round peg is slideably received within the non-round aperture. Therefore, the leading part of the projectile rotates conjointly with the trailing part of the projectile.

The primary object of this invention is to provide a multi-component projectile having a structure that causes the components of the projectile to rotate conjointly with one another when the projectile rotates about its axis of rotation.

Another important object is to provide a multi-component projectile that breaks apart open impact with a soft target.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
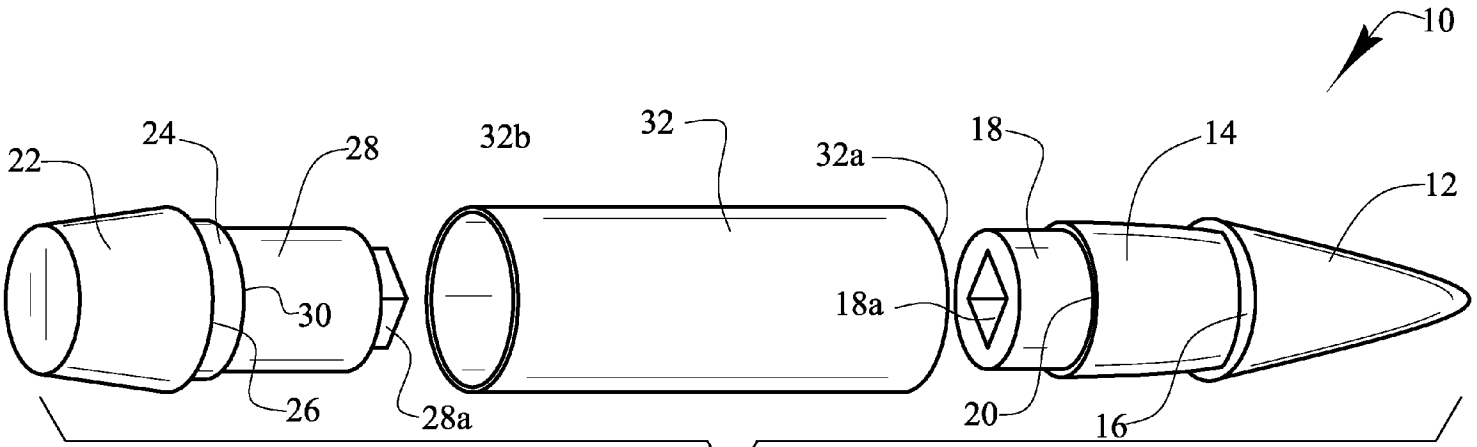
FIG. 1 is an exploded perspective view of the novel projectile.

Referring now to FIG. 1, it will there be seen that a diagrammatic representation of the novel multi-component projectile is denoted as a whole by the reference numeral 10.

Projectile 10 includes a leading part formed by nose cone or tip 12 having a generally ogive shape and tip base 14 of solid cylindrical construction having a reduced diameter so that first annular shoulder 16 is formed where the trailing end of tip 12 meets the leading end of tip base 14. Leading rod 18 has a reduced diameter so that second annular shoulder 20 is formed where the trailing end of tip base 14 meets the leading end of leading rod 18.

Projectile 10 further includes a trailing part formed by main base 22 which may have a frusto-conical shape as depicted but may have a cylindrical shape as well. Truncate base 24 of solid cylindrical construction has a reduced diameter relative to the leading end of frusto-conical main base 22 so that third annular shoulder 26 is formed where said leading end of frusto-conical main base 22 meets the trailing end of truncate base 24.

Trailing rod 28 is formed integrally with a leading end of truncate base 24 and has a reduced diameter relative to said leading end of said truncate base so that fourth annular shoulder 30 is formed where the leading end of truncate base 24 meets the trailing end of trailing rod 28.

Cylindrical interface 32 includes leading end 32*a* that abuttingly engages first annular shoulder 16 and trailing end 32*b* that abuttingly engages third annular shoulder 26.

Figure 2:
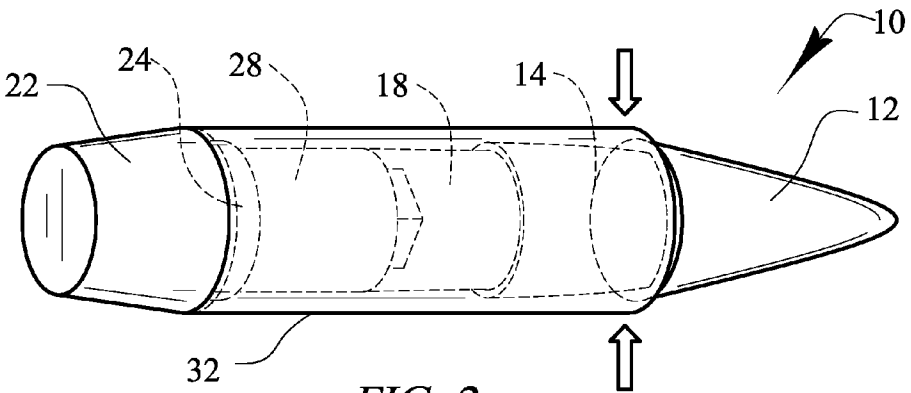
FIG. 2 is a perspective view of the substantially assembled projectile.
Figure 3:
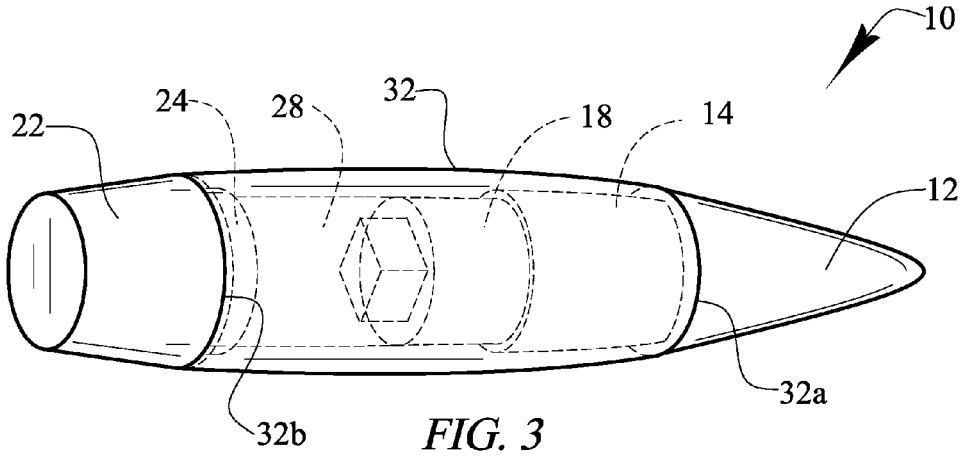
FIG. 3 is a perspective view of the completely assembled projectile.

As indicated in FIG. 2 by the radially inwardly directed arrows, an annular crimp is formed at leading end 32*a* of cylindrical interface 32 to produce the finished construction depicted in FIG. 3 where leading end 32*a* of cylindrical interface 32 is substantially flush with the trailing end of tip 12. The internal diameter of cylindrical interface 32 is greater than the external diameter of the trailing end of tip 12 because cylindrical interface 32 extends over tip 12 as cylindrical interface 32 is introduced into its FIG. 2 position.

The flat trailing end of leading rod 18 abuts the flat leading end of trailing rod 28 when leading end 32*a* of cylindrical interface 32 abuts first annular shoulder 16 and trailing end 32*b* of cylindrical interface 32 abuts third annular shoulder 26.

A square aperture 18*a* of predetermined depth is formed in the trailing end of leading rod 18. The center of square aperture 18*a* is coincident with the common longitudinal axis of symmetry of leading rod 18, tip base 14, and tip 12. That axis of symmetry is also the axis of rotation of projectile 10.

Mating square peg 28*a* of predetermined longitudinal extent is formed in the leading end of trailing rod 28. The predetermined longitudinal extent of square peg 28*a* is substantially equal to the predetermined depth of square aperture 18*a*. Accordingly, tip 12 rotates conjointly with frusto-conical base 22 when square peg 28*a* is fully seated within square aperture 18*a*.

The square configuration of aperture 18*a* and peg 28*a* is not critical to the invention. Any non-round aperture that is matched in configuration by a non-round peg is within the scope of this invention. A round aperture 18*a* having a keyway formed therein and a round peg 28*a* formed integrally with a mating key, or vice versa, is also within the scope of this invention.

Figure 4:
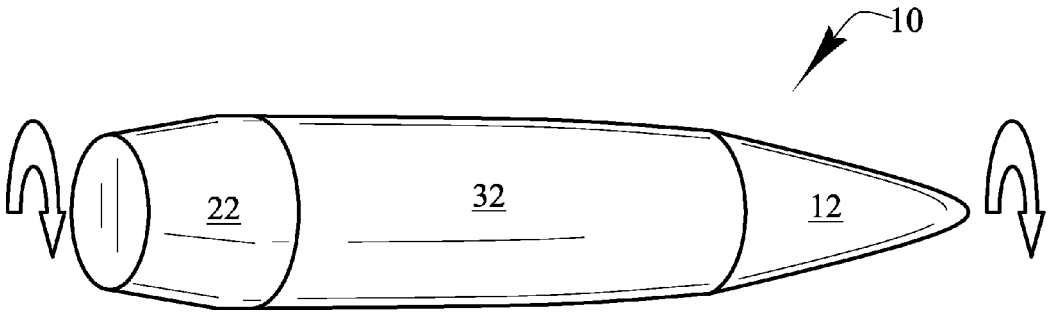
FIG. 4 is a perspective view like that of FIG. 3, including directional arrows.

The rotational arrows in FIG. 4 indicate the conjoint or synchronized rotation of tip 12, cylindrical interface 32, and main base 22 when projectile 10 is in flight.

Figure 5:
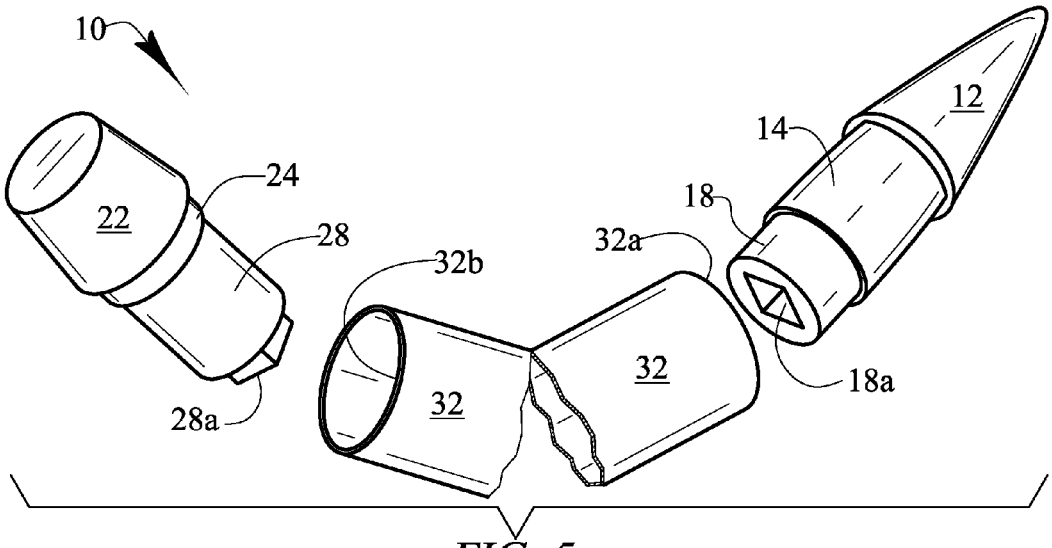
FIG. 5 is an exploded perspective view depicting the novel projectile when broken apart by impact with a soft target.

FIG. 5 depicts projectile 10 upon impact with a soft target. Such impact causes cylindrical interface 32 to fail. The failure of cylindrical interface 32 enables peg 28*a* and aperture 18*a* to separate from one another and such separation prevents further conjoint rotation of tip 12 and main base 22. Tip 12 and parts 14, 18 formed integrally with it, as well as main base 22 and parts 24, 28, 28*a* formed integrally with it, begin to yaw and the flight of projectile 10 ends within said soft target.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A projectile, comprising:

a leading part including a tip having a generally ogive shape;

a trailing part including a main base;

a cylindrical interface including a leading end that abuttingly engages a trailing end of said tip and a trailing end that abuttingly engages a leading end of said main base;

a non-round aperture having a predetermined longitudinal extent formed in said trailing end of said tip;

a non-round peg having a predetermined longitudinal extent substantially equal to the predetermined longitudinal extent of said non-round aperture formed in said leading end of said main base;

said non-round aperture and said non-round peg being centered on a longitudinal axis of symmetry of said projectile, said longitudinal axis of symmetry being a longitudinal axis of rotation of said projectile; and said non-round peg being slideably inserted within said non-round aperture when the leading end of said cylindrical interface abuts said trailing end of said tip and the trailing end of said cylindrical interface abuts said leading end of said main base so that said leading and trailing parts of said projectile rotate conjointly with one another when said projectile is rotating about said axis of rotation.

2. The projectile of claim 1, further comprising:

a tip base of cylindrical construction having a reduced diameter relative to said trailing end of said tip so that a first annular shoulder is formed where said trailing end of said tip meets a leading end of said tip base; and a leading rod formed integrally with said tip base and having a reduced diameter relative to said tip base so that a second annular shoulder is formed where a trailing end of said tip base meets a leading end of said leading rod.

3. The projectile of claim 2, further comprising:

a truncate base of cylindrical construction formed integrally with said leading end of said main base and having a reduced diameter relative to said leading end of said main base so that a third annular shoulder is formed where said leading end of said main base meets a trailing end of said truncate base;

a trailing rod formed integrally with a leading end of said truncate base and having a reduced diameter relative to said truncate base so that a fourth annular shoulder is formed where said leading end of said truncate base meets a trailing end of said trailing rod.

4. The projectile of claim 3, further comprising:

said leading end of said cylindrical interface disposed in abutting relation to said first annular shoulder and said trailing end of said cylindrical interface disposed in abutting relation to said third annular shoulder.

5. The projectile of claim 4, further comprising:

said non-round aperture formed in said trailing end of said leading rod.

6. The projectile of claim 5, further comprising:

said non-round peg formed in a leading end of said trailing rod.

7. The projectile of claim 6, further comprising:

said non-round peg being slideably disposed in said non-round aperture when said leading end of said cylindrical interface is disposed in abutting relation to said first annular shoulder and said trailing end of said cylindrical interface is disposed in abutting relation to said third annular shoulder so that said leading part of said projectile rotates conjointly with said trailing part thereof.

* * * * *